US006283894B1

(12) United States Patent
Steger

(10) Patent No.: US 6,283,894 B1
(45) **Date of Patent: *Sep. 4, 2001**

(54) TRAMPOLINE PAD ASSEMBLY

(75) Inventor: Ralph E. Steger, Baxley, GA (US)

(73) Assignee: Hedstrom Corporation, Bedford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/728,014

(22) Filed: Dec. 1, 2000

Related U.S. Application Data

(63) Continuation of application No. 09/337,244, filed on Jun. 22, 1999, now Pat. No. 6,193,632.

(51) Int. Cl.[7] ..... A63B 5/11; A63B 5/00
(52) U.S. Cl. ..... 482/27
(58) Field of Search ..... 482/27, 28, 29, 482/35; 182/139, 140

(56) References Cited

U.S. PATENT DOCUMENTS 4,431,182 * 2/1984 Reynolds ..... 272/65
4,900,011 * 2/1990 Nolet ..... 272/65
5,299,989 * 4/1994 Boyd et al. ..... 482/27
5,385,518 * 1/1995 Turner ..... 482/27
6,017,292 * 1/2000 Gift et al. ..... 482/27
6,193,632 * 2/2001 Steger ..... 482/27

* cited by examiner

*Primary Examiner*—Stephen R. Crow
(74) *Attorney, Agent, or Firm*—Cesari and McKenna

(57) ABSTRACT

A trampoline pad assembly for securement to a trampoline of the type including a rebound surface suspended by springs from an elevated ring includes an annular top wall and an annular bottom wall secured together at congruent inner and outer boundaries to form an annular enclosure defining an interior pocket. At least one opening is formed in the bottom wall, which opening extends into the pocket. Resilient material is introduced into the pocket through the opening and an annular flexible skirt is secured to top wall adjacent to the outer boundary thereof so that the skirt lies flat against the top wall. The skirt has a free edge which is shorter than the wall outer boundary and the skirt is foldable around those outer boundaries so that the skirt overlaps the opening thereby enclosing the resilient material within the pocket and secures the pad assembly to the ring.

6 Claims, 3 Drawing Sheets

TRAMPOLINE PAD ASSEMBLY

RELATED APPLICATION

This application is a continuation of Ser. No. 09/337,244, filed Jun. 22, 1999 now U.S. Pat. No. 6,193,632.

This application relates to a trampoline of the type having an elevated ring which supports a flexible rebound surface by means of springs stretched between the rebound surface and the ring. It relates especially to an annular pad for covering the ring and springs to protect those using the trampoline.

BACKGROUND OF THE INVENTION

Conventional trampolines are usually provided with an annular pad to cover the outer edge margin of the trampoline's rebound surface and the resilient connections of that surface to the ring which supports the rebound surface.

Conventional trampoline pad assemblies, which may or may not be filled with a resilient insert such as foam, usually include a gusset or skirt which is attached perpendicular to the plane of the pad surface. The circumference of the pad around the points of attachment to the trampoline frame is usually equal to the circumference of the bottom edge of the gusset. To install a pad on a trampoline, the pad is dropped down over the trampoline frame so that the gusset hangs downward around the perimeter of the ring which supports the trampoline's rebound surface. Usually, a draw cord is installed at the bottom edge of the gusset to reduce the circumference of that edge to a degree that prevents the cover from being lifted up from the trampoline frame. Since the materials used for the gusset are often stiff, the gusset does not gather neatly around the perimeter of the frame as the draw cord is tensioned. This leads to insufficient closure or diameter reduction of the gusset with result that those pads sometimes separate from the trampoline frame in the presence of high winds or during vigorous use of the trampoline.

In an attempt to alleviate that problem, some prior trampolines incorporate straps or ties which are used to attach the pad directly to various parts of the trampoline frame. However, with such direct connections, impacts on the pad when the trampoline is in use can cause the pad to shift relative to the frame resulting in the tearing of those straps or the pad itself.

Another disadvantage of the conventional trampoline pad assemblies of the type filled with a resilient insert such as foam is that the insert has to be installed at the factory when the pad envelope cover is stitched together. Therefore, the insert complicates the pad assembly process. Also, the factory-installed insert makes the pad relatively bulky so that it has to be shipped in a relatively large container. Further, if the insert should become damaged, it is difficult to repair.

SUMMARY OF THE INVENTION

Accordingly, it is an object of the present invention to provide an improved pad for a trampoline.

Another object of the invention is to provide a trampoline pad assembly which permits installation of foam material after the pad envelope is sewed together so that someone other than the sewing crew which assembled the pad envelope or cover can install the inserts at a remote location.

A further object of the invention is to provide a trampoline pad assembly having removable foam inserts which are securely retained in place when the pad is installed on a trampoline.

Yet another object of the invention is to provide a trampoline pad assembly which, when installed on a trampoline, cannot be lifted up from the trampoline frame.

A further object of the invention is to provide a pad of this type which suffers minimum stress when in use.

A further object of the invention is to provide a trampoline pad which can be manufactured and assembled relatively easily at relatively low cost.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my trampoline pad assembly, when properly dimensioned, can be installed on more or less any conventional trampoline having an elevated, flexible rebound surface resiliently connected to a rigid frame surrounding the rebound surface. The pad is positioned on the trampoline so that it covers the edge margin of the rebound surface and its connections to the frame. The pad includes an annular, flexible cover composed of upper and lower walls which are secured together at their inner and outer edges to form an annular enclosure for containing a resilient filler material such as foam. Superimposed on, and parallel to, the cover top wall is an annular skirt whose outer edge margin is secured to the cover top wall at the same time the top wall is secured to the cover bottom wall. Also, at least one opening is provided in the cover bottom wall adjacent the outer edge margin thereof so that filler material can be inserted through that opening into the cover interior after the cover has been assembled.

Preferably the assembly is composed of a plurality of arcuate pad segments secured together end to end to form a ring. Each segment defines a pocket for containing a foam insert which can be inserted into the pocket through an opening in the bottom wall of that segment.

After the cover has been filled with filler material, the pad may be installed on a trampoline by centering the pad on the trampoline and folding the skirt down around the ring on the trampoline frame. While the outer edge of the skirt is large enough to fit over the frame ring, the inner edge is not with a result that when the skirt is folded down over the frame ring, its free edge margin does not hang downward but rather extends inward under tension toward the center of the trampoline. The skirt thus not only prevents the pad assembly from inadvertently lifting from the trampoline, it also closes the openings into the pockets containing the filler material.

To accommodate the legs of the trampoline frame, notches are provided at the ends of the skirt segments to provide clearance for the legs. To positively secure the pad in place, ties are provided at the ends of the skirt segments. By lacing the ties through loops secured to the cover bottom wall, the lower or inner edge of the skirt is secured to the bottom wall so that the trampoline ring is positively captured by the skirt. With this arrangement, however, the pad assembly is not connected directly to the trampoline frame, but only to itself. Therefore, the pad assembly is free to move to some extent relative to the trampoline frame so that it does not become overstressed when the trampoline is in use.

As we shall see presently, the trampoline pad assembly is composed of relatively few parts which can be made and assembled quite easily. Therefore, the pad assembly should not add appreciably to the overall cost of the trampoline.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION OF AN ILLUSTRATIVE EMBODIMENT

Figure 1:
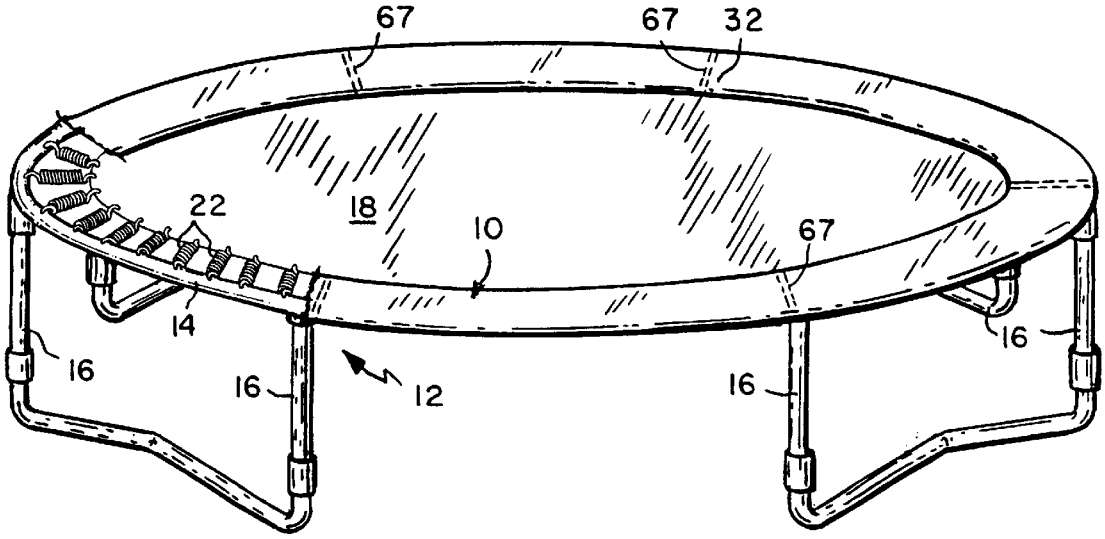
FIG. 1 is a perspective view with parts broken away showing my trampoline pad assembly installed on a conventional trampoline.
Figure 5:
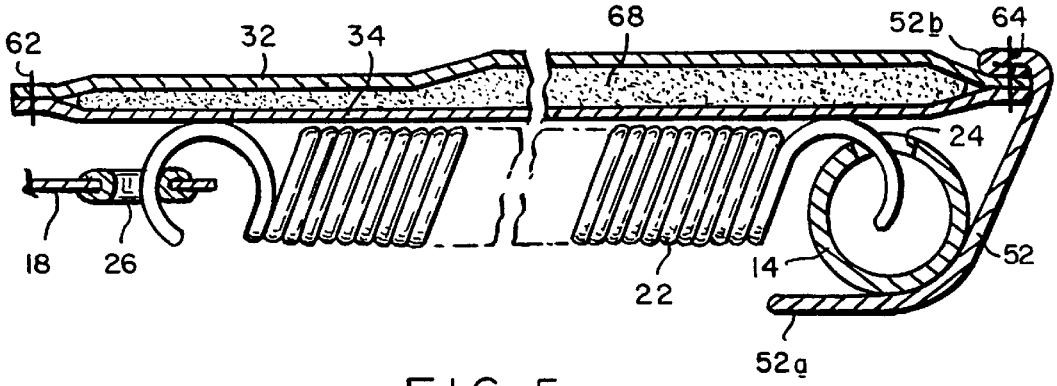
FIG. 5 is a sectional view taken along line 5—5 of FIG. 2 on a still larger scale showing the pad assembly installed on a trampoline.

Refer to FIG. 1 of the drawings which shows a trampoline pad assembly incorporating the invention shown generally at 10 installed on a more or less conventional trampoline indicated generally at 12. Trampoline 12 comprises a rigid frame consisting of a ring 14 supported at an elevated position above the floor or ground by a plurality of legs 16 extending down from the ring. Centered within the ring is a flexible rebound surface 18 whose edge margin is secured to the ring by an array of coil springs 22. As shown in FIG. 5, one end of each spring 22 is hooked through a hole 24 in the ring while the opposite end of that spring is hooked through a grommet or eye 26 present adjacent the edge of rebound surface 18. When a person jumps up and down on the rebound surface, the springs flex making that surface highly resilient.

Figure 2:
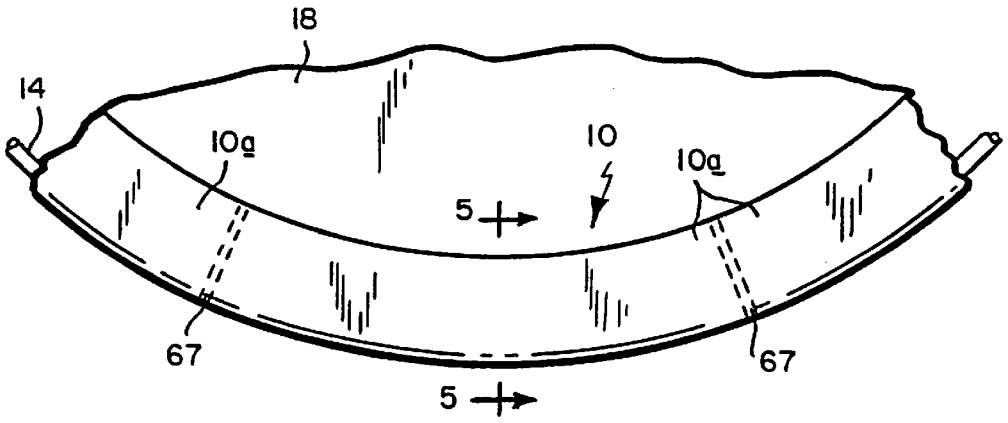
FIG. 2 is a fragmentary top plan view on a larger scale showing in greater detail the trampoline pad assembly illustrated in FIG. 1.

Referring now to FIGS. 1 and 2, the pad 10 is an annular assembly that covers the ring 14, springs 22 and the spring connections to the rebound surface 18. While a pad assembly could be a single round structure, it is preferably composed of a plurality of identical arcuate segments 10*a* secured together end to end. For a typical trampoline whose ring 14 has a diameter of 13 feet, pad 10 may be composed of eight pad segments 10*a,* each segment being about 5 feet long from end to end.

Figure 3:
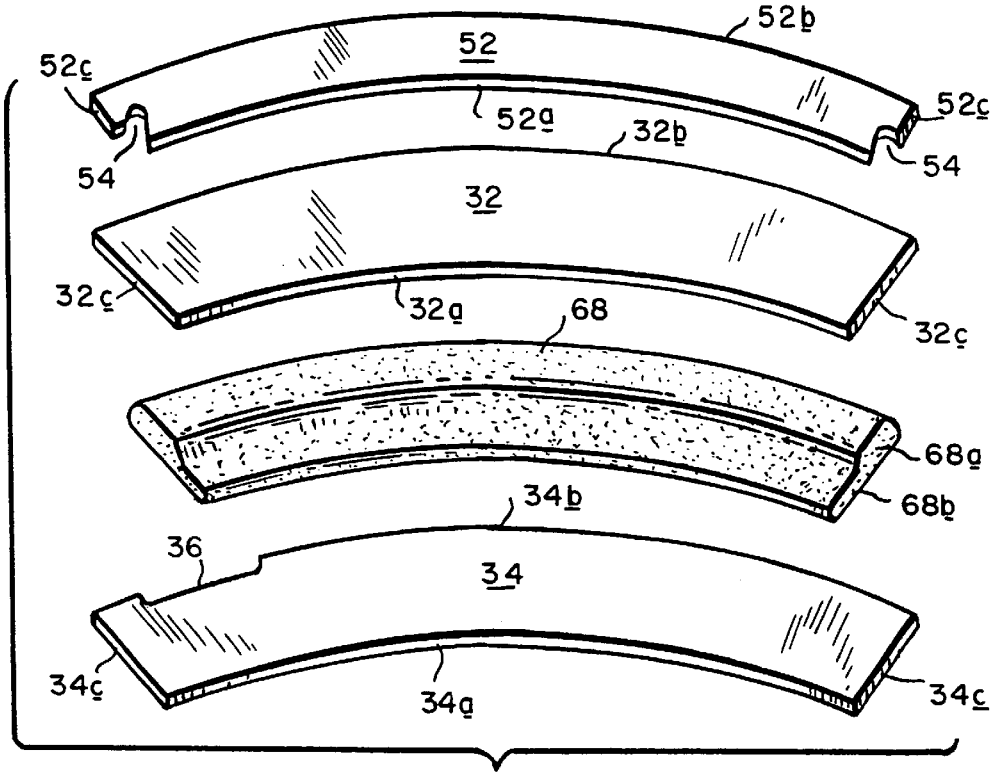
FIG. 3 is an exploded perspective view on a still larger scale showing the components of the FIG. 2 pad assembly.
Figure 4:
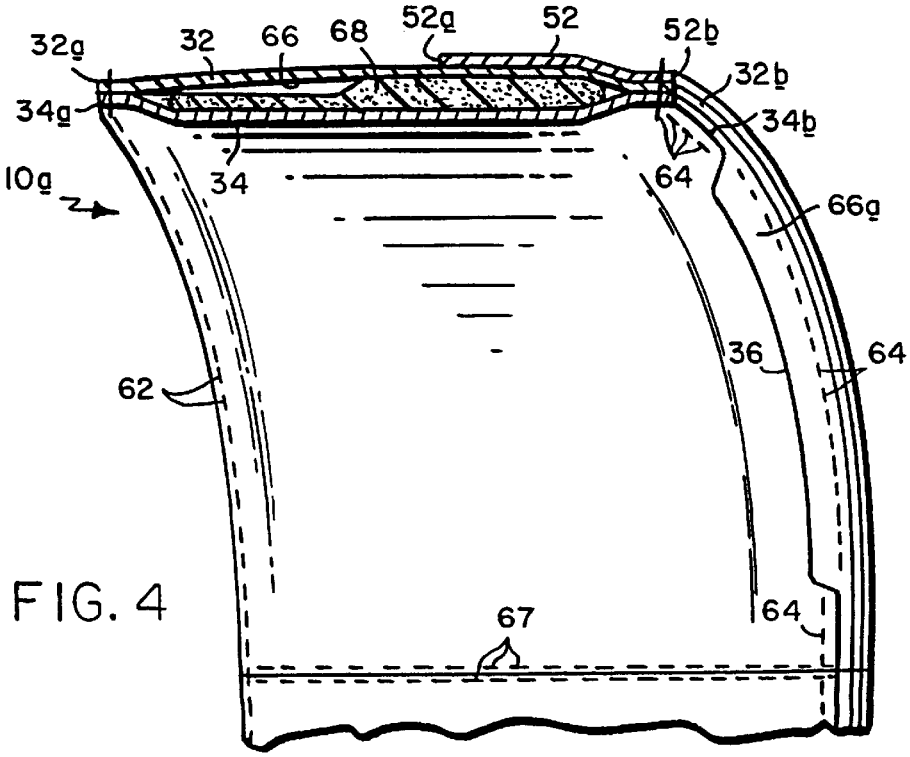
FIG. 4 is a fragmentary perspective view further illustrating the pad components and their assembly.

As best seen in FIGS. 3 and 4, each pad segment 10*a* comprises a flexible, arcuate upper wall 32 of a suitable flexible, weather-resistant sheet material such as vinyl plastic. Wall 32 has a radially inner edge 32*a,* a radially outer edge 32*b* and a pair of end edges 32*c*. The pad assembly also includes a more or less arcuate lower wall 34 having a radially inner edge 34*a,* an outer edge 34*b* and end edges 34*c*. The bottom wall 34 differs from top wall 32 in that it is formed with an elongated notch 36 at its outer edge 34*b* adjacent to one end edge 34*c,* e.g., the right hand edge as viewed in FIGS. 3 and 4.

The third component of the pad assembly 10*a* is an arcuate skirt 52 having a radially inner edge 52*a,* and outer edge 52*b* and a pair of end edges 52*c*. The length of gusset 52 is more or less the same as that of top wall 32 but its radial extent is only about half that of top wall 32 so that it corresponds more or less to the radially outer edge margin of top wall 32. Furthermore, as best seen in FIG. 3, a pair of notches 54 are formed in the end edges of skirt 52 adjacent the radially inner edge 52*a* thereof for reasons that will be described later.

As shown in FIG. 4, the pad segment 10*a* is assembled by placing top wall 32 on bottom wall 34 so that the two walls are more or less congruent and then situating skirt 52 on top wall 32 so that the outer end margins of the skirt and top wall are in register. Then, the radially inner edges 32*a* and 34*a* of the top and bottom walls are secured together by stitching 62, heat welds or other suitable means. Likewise, the radially outer edges 32*b,* 34*b* of those walls, along with the radially outer edge 52*b* of skirt 52, are secured together by similar means such as stitching 64. As is evident front FIG. 4, this stitching together of the top and bottom walls forms a pocket or enclosure 66 between the walls. Moreover, because of the presence of the notch 36 in bottom wall 34, the stitching 64 at the radially outer edge of each pad segment 10*a* does not capture bottom wall 34 at the location of the notch leaving an opening 66*a* into the pocket 66 between the two walls of the pad segment 10*a*.

During the same stitching operation, the ends of adjacent segments 10*a* are secured together by radial stitching 67. Because of the notches 54 in the ends of skirt 52, only the radially outer portions of the skirt ends radially outboard the notches are secured to the pad cover walls 32 and 34. When all segments 10*a* are stitched end to end they form an annulus with all of the skirts 52 together constituting a segmented annular flap.

In accordance with the invention, each pocket 66 in the pad assembly is arranged and adapted to contain a resilient filter material such as a foam insert 68 shown in FIGS. 3 to 5. Insert 68 is slightly shorter and narrower than pad segment walls 34*a* and 34*b*. Preferably also, it is formed with a relatively thick radially outer section 68*a* and a thinner radially inner section 68*b* to facilitate insertion of the pad 68 into pocket 66 and to enable the pad to lay flat on the trampoline when installed thereon.

While many conventional trampoline pad assembly assemblies require the filler material to be incorporated into the pad during the cover stitching operation, pad 10 assembly has a definite advantage in that inserts 68 can be installed into the pad segments 10*a* after the stitching operation at a remote location; the inserts can even be installed by the customer who purchases pad assembly 10.

The easiest way to install the inserts 68 is to place the stitched-together walls or cover of the pad assembly on a flat surface so that the pad bottom wall 34 faces upwards exposing the pockets openings 66*a*. Then, each insert 68 is folded lengthwise so that its thinner section 68*a* faces downward, i.e., toward skirt 52, and is inserted endwise through the opening 66*a* into the pocket 66 of a pad assembly segment 10*a*. As the insert is being worked into pocket 66, it is unfolded so that the thinner, radially inner section 68*b* of the insert occupies the radially inner section of pocket 66 as shown in FIG. 4.

Once all of the inserts 68 have been installed in all pad assembly segments 10*a*, the pad assembly is in condition to be installed on trampoline 12 as shown in FIG. 1. For this, the pad assembly is centered on the trampoline 10 with its lower wall 34 facing downward and with the skirts 52 of all of the pad segments 10*a* lying flat against and parallel to the assembly top walls 32 and parallel to the nominal plane of the trampoline rebound surface 18. The pad assembly should be oriented so that the connected together ends of the pad segments 10*a* at stitching 67 are located opposite the legs 16 as shown in FIG. 1. It is important to appreciate that the outer circumference of the stitched together edges of walls 32 and 34 and of skirt 52 is large enough so that those edges overlap the trampoline ring 14. However, the total circumference of the free edges of the combined skirts is much smaller. Indeed, it is smaller than the circumference of the rebound surface 18. Thus, it is too small to fit over the trampoline ring 14 except for the fact that the skirts 52 are not secured together end-to-end radially outboard from the notches 54 as described above.

As we shall see, the end notches 54 in the skirts 52 of adjacent segments 10*a* are mirror images of one another and together form relatively large openings to provide clearance for the trampoline legs.

Once pad 10 is properly centered on trampoline 12, the skirts 52 of the pad assembly segments 10*a* are flipped or folded downward over the trampoline ring 14 as shown in FIG. 5. Since the diameter of the free edges 52*a* of the combined skirts is smaller than that of the ring, the combined skirts do not just drape down from the ring. Rather, they extend under tension radially inward under the ring toward the center of the trampoline as shown in that figure. Thus, they tend to retain the pad assembly 10 on trampoline 12. They also close or cover all of the openings 66*a* in the pad assembly segments 10*a* thereby capturing the pad inserts 68 between walls 32 and 34.

In order to assure such retention even in the presence of high winds and vigorous activity on the trampoline, provision is made for positively securing the pad assembly 10 to the trampoline. However, unlike conventional pad constructions, this is done in such a way that the securement of the pad to the trampoline does not create undo stresses on the pad assembly.

Figure 6:
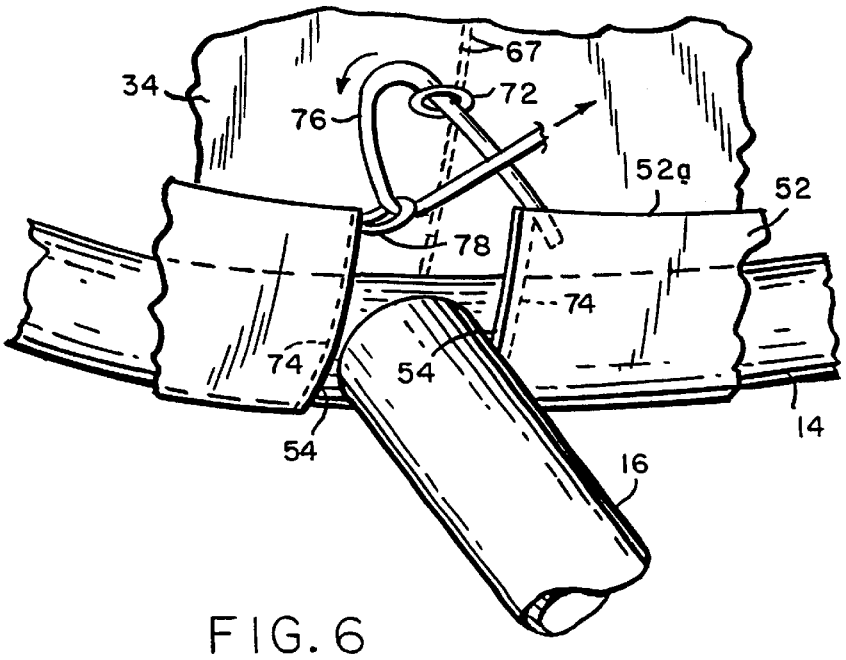
FIG. 6 is a fragmentary perspective view illustrating the securement of the pad to the trampoline frame.

More particularly, and referring to FIGS. 5 and 6, when connecting together the ends of adjacent pad segments 10*a* by stitching 67, a loop 72 is stitched to the exposed surface of bottom wall 34. Also, during that stitching operation, the edges of the skirt notches 54 are hemmed by stitching 74. During that process there is secured to the free radially inner end corner at one end of skirt 52 a tie string 76 and to a similar free corner at the opposite end of the skirt, a loop 78. Thus, when the pad assembly 10 is properly positioned on trampoline 12, a loop 72 is present radially inboard each trampoline leg 16 and a tie string 76 and loop 78 of adjacent pad assembly segments 10*a* are located on opposite sides of a trampoline leg 16, all is shown in FIG. 6.

To secure the pad to the trampoline, each tie string 76 is passed through the adjacent loop 72 at the underside of wall 34 and then passed through the adjacent loop 78 and tied back on itself. Tying the ends of each segment 10*a* of the pad assembly completes the closure of a circular skirt perimeter that is much smaller than the ring 14. Also, lacing all of the tie strings 76 as aforesaid draws the pad assembly 10 centerline down close to the plane of the rebound surface 18. This is desirable because the thickest part of the pad rests on top of the trampoline springs 22. Accordingly, there is a tendency for the center of the pad to be lifted up above the rebound surface. Also, of course, the lacing of the tie strings 76 enhances the security of attachment of the pad assembly 10 to trampoline 12.

It is important to note, however, that the pad assembly is not tied directly to the trampoline frame, but only to itself. In other words, while the pad assembly captures the trampoline ring 14, it is still free to move relative to the ring and the trampoline frame as a whole. In other words, the pad assembly is still somewhat mobile. Thus, if pad 10 is stressed momentarily at one segment 10*a,* tension is increased in the remaining segments to pull the pad assembly as a whole back to its centered position. Such mobility also minimizes stresses on the pad when the trampoline is in use.

It will be appreciated from the foregoing that the trampoline pad assembly described above has definite advantages over existing pads of this general type in that it permits installation of the resilient inserts 68 into the otherwise finished pad. This can be done by unskilled personnel at the factory after the stitching operations on the pad assembly have been completed. Of course, the inserts can also be installed by the person who purchases the pad allowing the pad to be shipped and stored in a smaller space than the space required by a pad assembled completely at the factory. This construction also allows the inserts 68 to be easily removed and replaced if need be. When the pad assembly is installed on a trampoline, it remains centered in place and is relatively unaffected by high winds and activity on the trampoline. Yet, the pad assembly is relatively easy to make and does not cost appreciably more than existing pads of this type which do not have the above advantages.

It will thus be seen that the objects set forth above, among those made apparent from the preceding description, are efficiently attained. Also, certain changes may be made in the above construction without departing from the scope of the invention. For example, the foam inserts 68 may be substituted for by padding on other filler material such as foam pieces. Therefore, it is intended that all matter contained in the above description or shown in the accompanying drawings shall be interpreted as illustrative and not in a limiting sense.

What is claimed is:

1. A trampoline pad assembly for securement to a trampoline of the type including a rebound surface suspended by springs from an elevated ring, said assembly comprising an annular top wall and an annular bottom wall secured together at congruent inner and outer wall boundaries to form an annular enclosure defining an interior pocket;

means defining at least one opening in said bottom wall, said at least opening extending into the pocket;

resilient material introduced into the pocket through said at least one opening, and an annular flexible skirt secured to the top wall adjacent to the outer boundary thereof so that the skirt lies flat against said top wall, said skirt having a free edge which is shorter than said outer congruent boundaries and said skirt being foldable around said outer congruent boundaries so that the skirt overlaps said at least one opening thereby enclosing said resilient material within said pocket.

2. The pad assembly defined in claim 1 and further including securing means for securing the free edge of the skirt to said bottom wall so that the skirt forms an annular tube adjacent to said congruent outer boundaries for encircling said ring.

3. The pad assembly defined in claim 2 wherein the securing means comprise a tie or an eye secured to the free edge of the skirt and to the bottom wall.

4. The pad assembly defined in claim 1 wherein the top and bottom walls are of plastic sheet material and the resilient material is plastic foam.

5. The pad assembly defined in claim 1 wherein the top and bottom walls and skirt are composed of arcuate segments secured together end-to-end so that said pocket is composed of separate arcuate pocket segments;

an opening is present in each bottom wall segment, and said resilient material comprises a separate arcuate insert in each of said pocket segments.

6. The pad assembly defined in claim 5 wherein each insert has a relatively thick radially outer section and a thinner radially inner section.

* * * * *